US005398950A

United States Patent [19]

Tkaczyk

[11] Patent Number: 5,398,950

[45] Date of Patent: Mar. 21, 1995

[54] INTERCHANGEABLE ROLLER SKATE

[76] Inventor: John Tkaczyk, 3615 W. Leland Ave., #2, Chicago, Ill. 60625

[21] Appl. No.: 147,956

[22] Filed: Nov. 4, 1993

Related U.S. Application Data

[62] Division of Ser. No. 938,438, Aug. 31, 1992, Pat. No. 5,286,043.

[51] Int. Cl.[6] ..... A63C 1/26

[52] U.S. Cl. ..... 280/11.23; 280/11.25

[58] Field of Search ..... 280/11.22, 11.23, 11.27, 280/11.28, 11.19, 11.25, 11.26

[56] References Cited

U.S. PATENT DOCUMENTS

| | | | |
|---|---|---|---|
| 622,815 | 4/1899 | Lindsley . | |
| 681,368 | 8/1901 | Kent . | |
| 684,260 | 10/1901 | Jassmann . | |
| 857,925 | 6/1907 | Cure . | |
| 1,616,952 | 2/1927 | Dahl . | |
| 1,728,063 | 9/1929 | James | 280/11.23 |
| 2,517,322 | 8/1950 | Kahle | 280/11.23 X |
| 2,563,919 | 8/1951 | Christensen . | |
| 2,935,331 | 5/1960 | Ledgerwood . | |
| 3,086,787 | 4/1963 | Wyche | 280/11.23 X |
| 3,365,208 | 1/1968 | Blanchard | 280/11.23 X |
| 3,484,116 | 12/1968 | Allen . | |
| 3,767,220 | 10/1973 | Peterson . | |
| 3,876,217 | 4/1975 | Copier . | |
| 3,963,252 | 6/1976 | Carlson | 280/11.22 |
| 4,058,324 | 11/1977 | Dallaire . | |
| 4,363,492 | 12/1982 | Eriksson . | |
| 4,445,699 | 5/1984 | Darasko . | |
| 4,603,868 | 8/1986 | Schütz . | |
| 4,943,075 | 7/1990 | Gates . | |
| 4,991,861 | 2/1991 | Carn et al. . | |
| 5,046,746 | 9/1991 | Gierveld . | |

*Primary Examiner*—Richard M. Camby
*Assistant Examiner*—Michael Mar
*Attorney, Agent, or Firm*—Wallenstein, Wagner & Hattis, Ltd.

[57] ABSTRACT

The present invention generally relates to a roller skate, and preferably an in-line roller skate having a foot platform suspended between front and rear wheels for increased stability. One feature the present invention is a retractable wheel positioned between the front and rear wheels. Another feature of the invention is a contoured toe piece removably attached to the foot platform and a heel piece pivotably attached to the foot platform. A still further feature of the invention is that the heel piece is slidable to allow the skate to accommodate shoes of various sizes. A still further feature of the present invention is its effective and easy to use streamline brake system.

10 Claims, 3 Drawing Sheets

INTERCHANGEABLE ROLLER SKATE

This is a divisional of application Ser. No. 07/938,438, filed on Aug. 31, 1992, now U.S. Pat. No. 5,286,043.

DESCRIPTION

1. Technical Field

The present invention generally relates to in-line roller skates.

2. Background Prior Art

Various types of in-line roller skates are well known in the art. Examples of such roller skates are disclosed in U.S. Pat. Nos. 622,815; 681,368; 3,767,220; 4,363,492 and 4,943,075, the disclosures of which are incorporated in their entirety by reference herein.

One problem with in-line roller skates is that they are difficult to turn and maneuver, especially when the wearer is traveling at a high rate of speed. Consequently, the skates can only be used safely in large open areas and at low speeds.

Another problem with typical in-line skates is that the skater has difficulty in stopping, especially when skating at a high rate of speed. When the skates are provided with brakes, the brakes are either cumbersome to use or have parts that project from the sides of the skates which can be easily broken during use and are hazardous to the skater.

A still further problem with typical in-line skates is that the wheels do not wear down evenly. A skater who favors his or her right foot will wear down the wheels on the right skate more quickly. In addition, the inside edges of the wheels tend to wear down more quickly. In-line skates are not usually interchangeable between the right and left feet. This problem can be overcome by using the skates alternately on different feet, but skates are typically not interchangeable.

A still further problem with typical in-line skates is that they are not adjustable to accommodate differences in shoe or foot sizes of different skaters.

The various features of the present invention overcome one or more of these problems.

SUMMARY OF THE INVENTION

The present invention generally relates to roller skates, and preferably in-line roller skates each having a foot platform suspended between front and rear wheels for increased stability.

One feature the present invention is a retractable wheel positioned between the front and rear wheels of each skate. The advantage of the retractable wheel is that it can be lowered to facilitate turning and maneuvering. The retractable wheel lifts the front and rear wheels off the ground and forms a pivot point that permits quick turns and maneuvers, even at increased rates of speed.

Another feature of the invention is a contoured toe piece removably attached to the foot platform and a heel piece preferably pivotably attached to the foot platform. The toe and heel pieces allow each skate to be used on either the right or left shoe of a skater. This interchangeability permits more even wear and longer useful life of the wheels.

A still further feature of the invention is that the heel piece is slidable to allow the skate to accommodate shoes of various sizes. Thus, the skate can be easily adjusted to fit different sized feet and shoes. This allows a single pair of in-line skates to be worn comfortably and securely by many different skaters.

A still further feature of the present invention is its effective and easy to use streamline brake system. This brake system can be either a manual brake assembly or a cable controlled brake assembly. Both brake assemblies are streamline and do not project outward from the outer side margins of the skate platform. This design helps prevent the brakes of the two skates from striking each other or stationary objects during use. Thus, the brakes are more effective, last longer and are safer to use.

Other features and advantages of the invention will be apparent from the following specification taken in conjunction with the following drawings.

DETAILED DESCRIPTION

Figure 1:
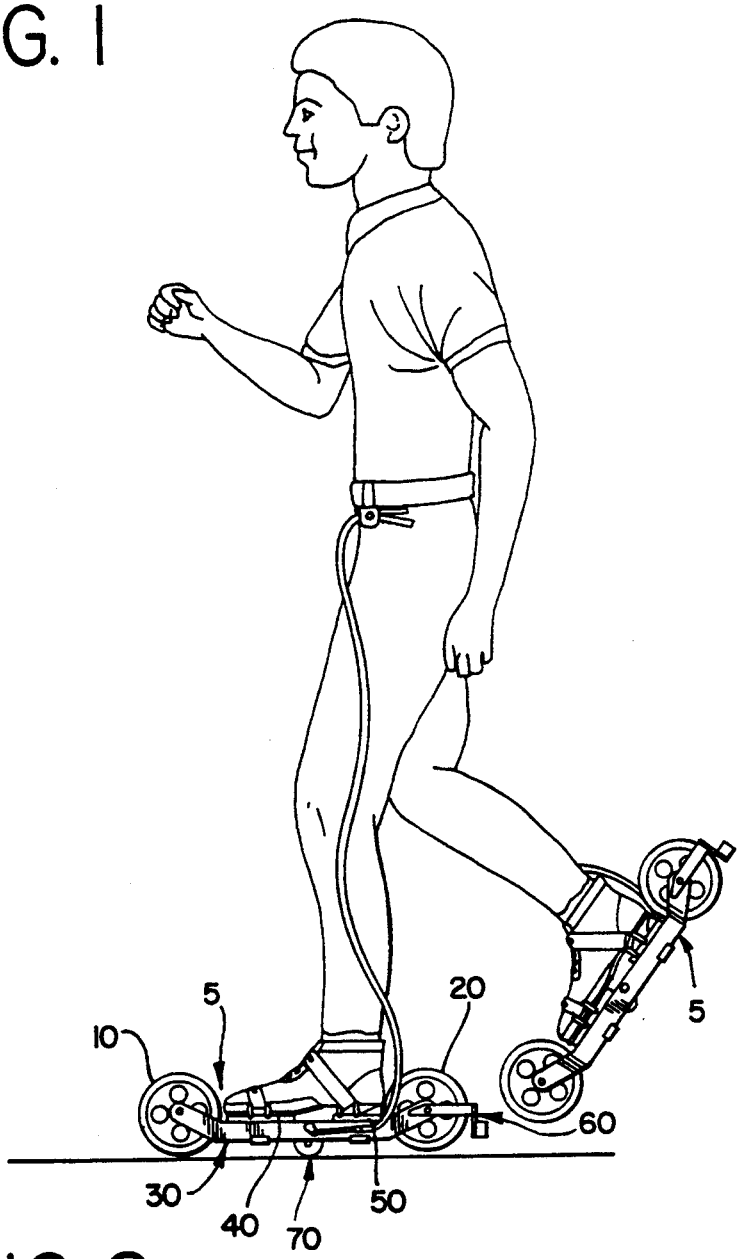
FIG. 1 is a prospective view of the present invention in use.

While this invention is susceptible of embodiments in many different forms, there is shown in the drawings, and will herein be described in detail, preferred embodiments of the invention with the understanding that the present disclosure is to be considered as an exemplification of the principles of the invention and is not intended to limit the broad aspects of the invention to the embodiments illustrated.

As shown in FIGS. 1–4, the exemplary form of the present invention is a pair of in-line roller skates 5—5 of superior design that facilitate quick turns and maneuvers. The skates are also interchangeable to equalize roller wear. Each skate comprises a front wheel 10, a rear wheel 20, a foot platform 30, a toe piece 40, a heel piece 50, a brake assembly 60 and a retractable wheel 70.

Front and rear wheels 10 and 20 have axles 12 and 22 that are preferably rotatably supported by frictionless bearings 14 and 24 respectively. Wheels 10 and 20 are preferably about six (6) inches in diameter to provide a skate capable of greater rates of speed than smaller diameter wheels.

Foot platform 30 is preferably comprised of a pair of connecting members 32 and 33 that support toe and heel pieces 40 and 50. Connecting members 32 and 33 have front ends 34 and 35, rear ends 36 and 37, and middle portions 38 and 39 respectively. Connecting members 32 and 33 are spaced to accommodate the front and rear wheels 10 and 20. Front wheel 10 is located between front ends 34 and 35. Rear wheel 20 is located between rear ends 36 and 37. The ends of axles 12 and 22 are preferably secured to platform 30 by inserting them through holes or slots provided in ends 34–37 of connecting members 32 and 33. Ends 34–37 also preferably slope downwardly in the direction of middle portions 38 and 39 so that middle portions 38 and 39 are below axles 12 and 22. This adds stability to foot platform 30.

Toe and heel pieces 40 and 50 are secured to the middle portions 38 and 39 of connecting members 32 and 33. Toe and heel pieces 40 and 50 are adjustably secured to accommodate different sized feet/shoes and to allow the skate to be used on either the right or left foot of the skater. Non-skid surfaces (not shown) are preferably secured to the top of toe and heel pieces 40 and 50.

Figure 2:
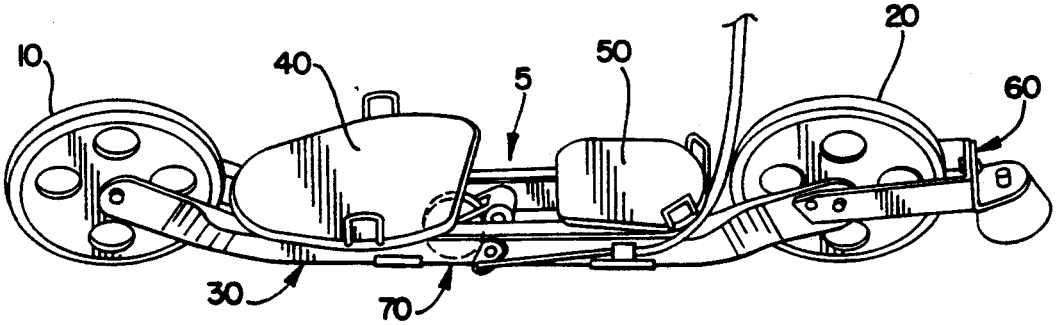
FIG. 2 is a prospective view of the present invention.
Figure 3:
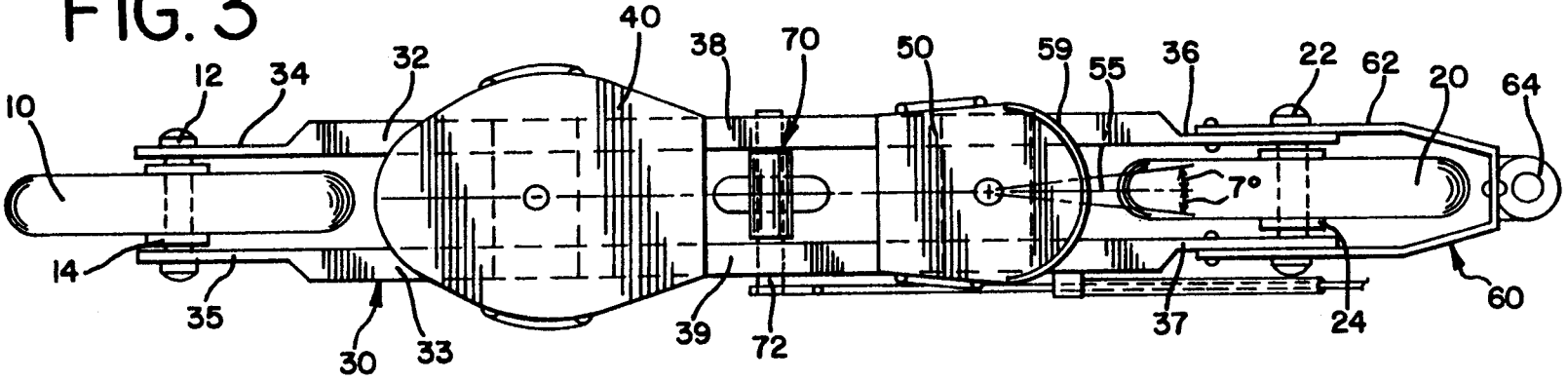
FIG. 3 is a top view of the present invention.

Toe piece 40 can be symmetrically shaped to accommodate either a left or a right shoe, as shown in FIG. 3. Toe piece 40 can also be contoured to accommodate the specific shape of a left shoe, or the specific shape of a right shoe, as shown in FIG. 2. When a specific toe shape is provided, toe piece 40 is removably secured to middle portions 38 and 39, preferably by use of a screw 42 and plate 44. Removable securement enables the right and left toe pieces to be interchanged so that a single skate may be used on either the right or left foot of the skater. Heel piece 50 is also adjustably secured to middle portions 38 and 39, preferably by use of a screw 52 and plate 54. By loosening screw 52, heel piece 50 can be slid forward or backward along middle portions 38 and 39 to fit the foot of the skater. Heel piece 50 is then rigidly secured in place by tightening screw 52.

As shown in FIG. 3, heel piece 50 can also be rotated clockwise or counterclockwise from a centerline 55 of foot platform 30 so that the same skate can be used on either the right or left foot of the skater. To accommodate a left foot, heel piece 50 is rotated clockwise about seven degrees (7°). To accommodate a right foot, heel piece 50 is rotated counterclockwise about seven degrees (7°). Although a typical shoe heel is rotated about 7° off center, it should be obvious that heel piece 50 could be rotated more or less depending on the specific shoe or foot of the wearer. By providing a rotatable heel piece 50, an interchangeable skate is provided that snugly fits the shoe of the skater.

Clips 46 and 56 and straps 47 and 57 are preferably provided as a means for fastening the roller skate to the skater's foot or shoe. Buckles 48 and 58 are preferably provided for securing and adjusting straps 47 and 57 to snugly fit the foot and ankle of the skater. A heel stop 59 is also provided to facilitate snug attachment of the skate.

A streamline manual brake assembly 60 can be secured to the rear ends 36 and 37 of connecting members 32 and 33. Axle 22 is preferably used to mount a "U" shaped plate 62 that extends around rear wheel 20. A brake pad 64 is connected to plate 62 to form the most rearward portion of the skate. By lifting his/her foot, the skater can direct the brake pad into the ground to stop or push off as desired.

Figure 4:
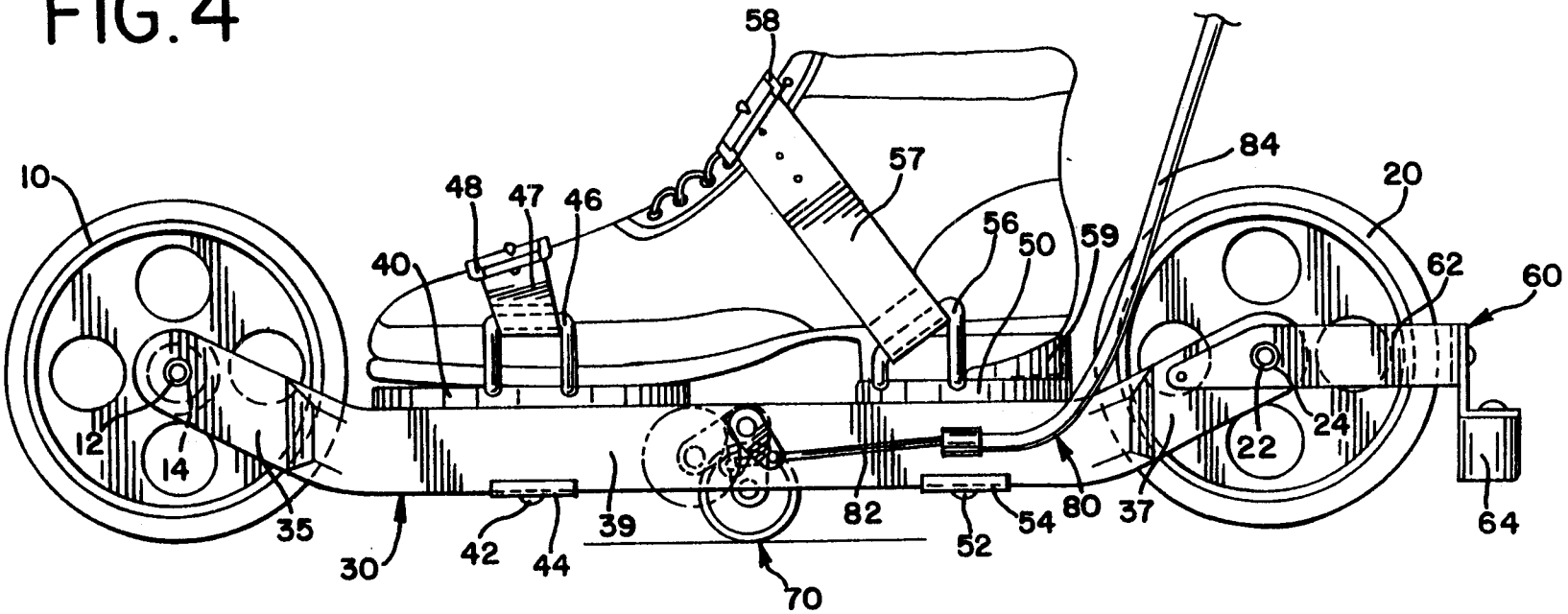
FIG. 4 is a side elevational view of the present invention.

Retractable wheel 70 is located between wheels 10 and 20, and is rotatably mounted on a support 72. Support 72 is preferably pivotally mounted between connecting rods 32 and 33. As shown in FIG. 4, wheel 70 has an up position and a down position. In its up or retracted position, wheel 70 is positioned directly between connecting members 32 and 33, and does not engage the ground. In its down position, wheel 70 engages the ground and lifts front and rear wheels 10 and 20 off the ground. This provides a single rolling pivot point 85 upon which a skater can quickly turn and maneuver. Retractable wheel 70 is preferably located directly underneath the skater's center of gravity so that front and rear wheels 10 and 20 are both lifted off the ground when retractable wheel 70 is lowered. In the down position, the lowest portion of retractable wheel 70 is preferably ¼ inch below the lowest portion of wheels 10 and 20.

A cable control device 80 is preferably provided for lowering and raising retractable wheel 70. Device 80 is a typical cable control device having a cable 82 and a outer shell 84. One end of cable 82 is attached to retractable wheel support 72. The other end of cable 82 is attached to an actuator (not shown) for pulling the cable. The actuator is preferably secured to a belt worn around the waist of the skater. When cable 82 is pulled by the actuator, support 72 pivots and lowers wheel 70 into its down position. The actuator preferably lowers retractable wheel 70 on both the right and left feet of the skater simultaneously. The actuator is also preferably provided with a spring (not shown) that biases wheel 70 into its retracted or up position.

Figure 5:
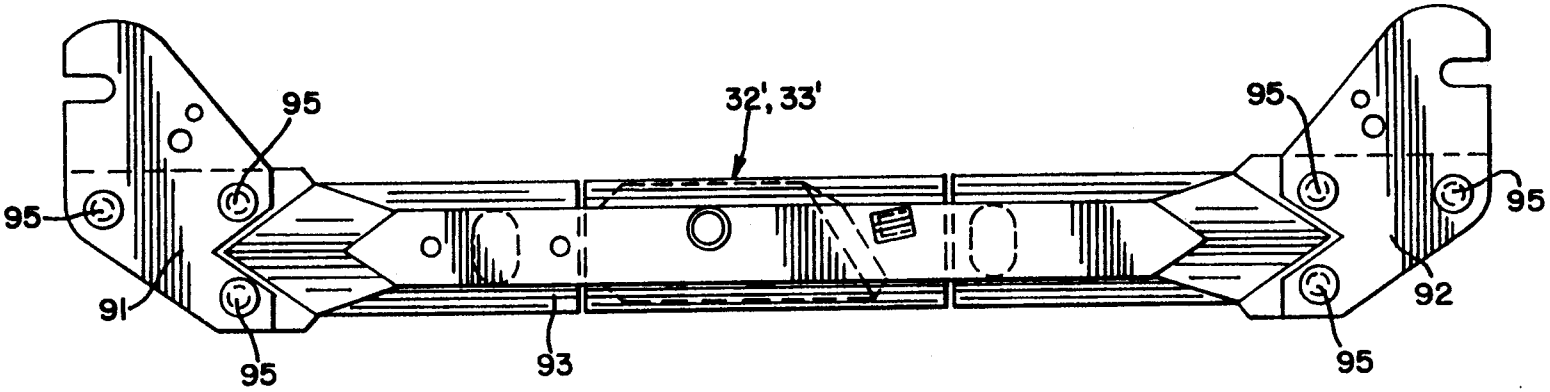
FIG. 5 is a side view of a three-piece connecting member which can be used instead of the connecting member shown in the skate of FIGS. 1–4.

Connecting members 32 and 33 are each shown in FIGS. 1–4 as one piece. As shown in FIG. 5, corresponding connecting members 32′ and 33′ are each made of three separate pieces—a front bracket 91, a rear bracket 92 and a center portion 93. These pieces are interconnected by suitable fastening means 95. Brackets 91 and 92 lower central portion 93 below wheel axles 12 and 22. Center portion 93 need not be bent, and can therefore be manufactured from a thinner piece of tubing without compromising structural strength. The use of thinner tubing advantageously reduces the overall weight of the roller skate.

Figure 6:
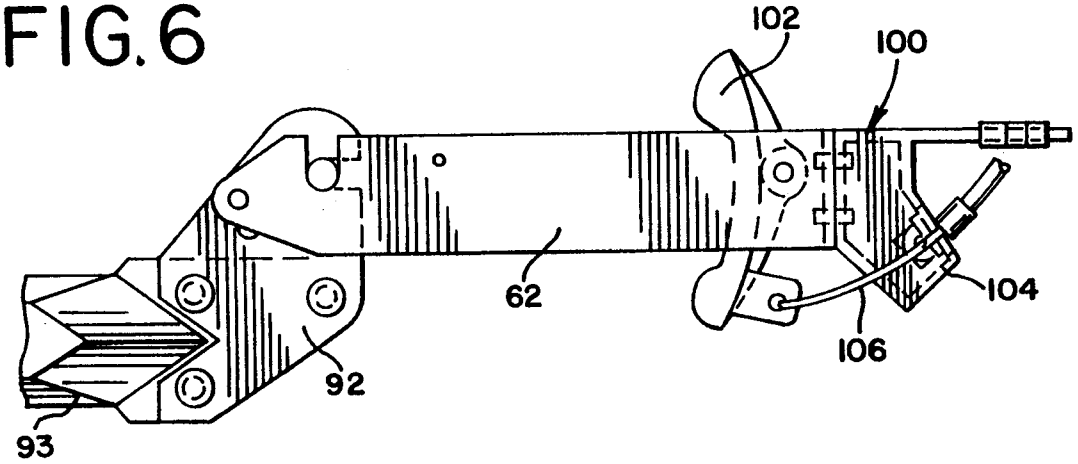
FIG. 6 is a side view of a cable controlled brake assembly which can replace the different brake assembly shown in FIGS. 1–4, the brake usually being connected to the rear of the connecting member shown in FIG. 5.

As shown in FIG. 6, each in-line skate 5 can be provided with a streamline cable control brake assembly 100. Brake 100 is connected to the rear end of connecting member piece 92—92 of FIG. 5. This brake assembly is installed in place of the manual brake assembly 60 shown in FIGS. 1–4. Brake system 100 preferably utilizes "U" shaped plate 62. A brake pad 102 is pivotally mounted inside "U" shaped plate 62. A cable support member 104 is secured to the end of "U" shaped plate 62. One end of cable 106 is secured to one end of pad 102. When the skater actuates cable control system 100, one end of pad 102 is pivoted toward cable support member 104, and the other end of pad 102 is pivoted toward the outer edge of wheel 20. This causes pad 102 to frictionally engage wheel 20 and decelerate the skater.

It will be understood that the invention may be embodied in-other specific forms without departing from the spirit or central characteristics thereof. The present examples and embodiments, therefore, are to be considered in all respects as preferred, specific aspects of the invention and not restrictive as to the broader aspects of the invention.

I claim:

1. A roller skate that is interchangeable between right and left shoes of a skater, said roller skate comprising:

front wheel means;

rear wheel means; and a foot platform suspended between said front and rear wheel means, said foot platform having a toe piece and a heel piece, said heel piece having a curved rearward wall shaped to conform to a heel of each of said right and left shoes, said heel piece being pivotable a predetermined amount about an upstanding axis between two selectable positions for accommodating either the right or left heels of the shoes of the skater, depending upon the selected position of the heel piece.

2. The roller skate of claim 1, wherein said heel piece is slidably attached to said foot platform to adjust to the size of the shoe of the skater.

3. The roller skate of claim 1, wherein said toe piece is a contoured toe piece adapted for comfortable use only with the right or left shoe of the user and removably attached to said foot platform to allow the skate to be worn on the right or left shoe of the skater.

4. The roller skate of claim 1 wherein said foot platform is further comprised of connecting members suspended from an axle of said front wheel and an axle of said rear wheel, each connecting member having a middle portion and front and rear ends, said middle portion being below said axles, and said connecting member being spaced to accommodate said front wheel between said front ends and said rear wheel between said rear ends.

5. The roller skate of claim 1 wherein the roller skate is an in-line roller skate with said front wheel means being in-line with said rear wheel means.

6. A pair of roller skates to be worn on the right and left shoes of a skater, the pair of roller skates comprising:

a first roller skate having a first set of front and rear wheel means and a first foot platform suspended between said first front and rear wheel means;

a second roller skate having a second set of front and rear wheel means and a second foot platform suspended between said second front and rear wheel means;

a first toe piece contoured to the shape of a front portion of the skater's right shoe; and a second toe piece contoured to the shape of a front portion of the skater's left shoe; and fastener means including a plate and a screw for removably securing each of said first and second toe pieces to either of said first and second platforms respectively so as to permit the pair of skates to be interchangeable between the skater's right and left shoes.

7. The roller skate of claim 6, wherein each said foot platform has a heal piece shaped to accommodate both the right and left heel of the shoe of the skater.

8. The roller skate of claim 7, wherein said heel piece is slidably attached to said foot platform to adjust to the size of the shoe of the skater.

9. The roller skate of claim 6, wherein each said foot platform is further comprised of connecting members suspended from an axle of said front wheel and an axle of said rear wheel, each connecting member having a middle portion and front and rear ends, said middle portion being below said axles, and said connecting member being spaced to accommodate said front wheel between said front ends and said rear wheel between said rear ends.

10. The roller skate of claim 6, wherein each roller skate is an in-line roller skate with said front wheel means being in-line with said rear wheel means.

* * * * *

UNITED STATES PATENT AND TRADEMARK OFFICE

CERTIFICATE OF CORRECTION

PATENT NO. : 5,398,950

DATED : March 21, 1995

INVENTOR(S) : John Tkaczyk

It is certified that error appears in the above-indentified patent and that said Letters Patent is hereby corrected as shown below:

Col. 4, line 66, change "heels" to -- heel --.

Col. 5, line 10, after "1" insert a -- , --;

line 20, after "1" insert a -- , --.

Signed and Sealed this

Thirtieth Day of May, 1995

Bruce Lehman

*Attest:*

BRUCE LEHMAN

*Attesting Officer*

*Commissioner of Patents and Trademarks*